US012778249B2

(12) United States Patent
Zhang et al.

(10) Patent No.: US 12,778,249 B2
(45) Date of Patent: Nov. 3, 2026

(54) TELESCOPIC SUITCASE, AND NOVEL PULL ROD AND SUITCASE BODY THEREOF

(71) Applicants: Xiaoyi Zhang, Xiamen (CN); Xingpan Jin, Xiamen (CN); Yifan Ding, Xiamen (CN)

(72) Inventors: Xiaoyi Zhang, Xiamen (CN); Xingpan Jin, Xiamen (CN); Yifan Ding, Xiamen (CN)

( * ) Notice: Subject to any disclaimer, the term of this patent is extended or adjusted under 35 U.S.C. 154(b) by 411 days.

(21) Appl. No.: 18/281,580

(22) PCT Filed: Jul. 5, 2022

(86) PCT No.: PCT/CN2022/103929

§ 371 (c)(1),
(2) Date: Sep. 12, 2023

(87) PCT Pub. No.: WO2023/005624

PCT Pub. Date: Feb. 2, 2023

(65) Prior Publication Data

US 2024/0156226 A1 May 16, 2024

(30) Foreign Application Priority Data

Jul. 29, 2021 (CN) ..... 202110864535.3
Jul. 29, 2021 (CN) ..... 202110866363.3
Jul. 29, 2021 (CN) ..... 202121746957.2

(51) Int. Cl.
*A45C 7/00* (2006.01)
*A45C 13/26* (2006.01)

(52) U.S. Cl.
CPC ..... *A45C 7/0031* (2013.01); *A45C 13/262* (2013.01); *A45C 2013/267* (2013.01)

(58) Field of Classification Search
CPC ..... A45C 7/0031; A45C 13/262; A45C 2013/267
(Continued)

(56) References Cited

U.S. PATENT DOCUMENTS 5,819,891 A 10/1998 Wang et al.
6,196,366 B1 * 3/2001 Lin ..... A45C 13/262 280/37
(Continued)

FOREIGN PATENT DOCUMENTS

CN 202603896 U 12/2012
CN 204698030 U * 10/2015
(Continued)

*Primary Examiner* — Nathan J Jenness
*Assistant Examiner* — Jessica Kavini Tamil
(74) *Attorney, Agent, or Firm* — Bayramoglu Law Offices LLC

(57) ABSTRACT

A telescopic suitcase and a novel pull rod and suitcase body thereof are provided. The telescopic suitcase includes a novel pull rod and a suitcase body, where the novel pull rod includes suitcase body fixing tubes, suitcase body moving tubes, and telescopic rods; the suitcase body includes an upper suitcase body and a lower suitcase body; a lower end of the upper suitcase body is sleeved outside the lower suitcase body; a capacity of the suitcase is adjusted by changing relative positions of the upper suitcase body and the lower suitcase body; the suitcase body moving tubes each include an upper end fixedly connected to the upper suitcase body and a lower end provided with a first locking element; the suitcase body fixing tubes are fixedly connected to the lower suitcase body; the lower end of the suitcase body moving tube is sheathed inside the suitcase body fixing tube.

3 Claims, 9 Drawing Sheets

(58) Field of Classification Search
USPC ..... 190/104
See application file for complete search history.

(56) References Cited

U.S. PATENT DOCUMENTS

| | | | | |
|---|---|---|---|---|
| 8,646,584 | B2 * | 2/2014 | Moussatche | A45C 13/262 16/113.1 |
| 2004/0237605 | A1 * | 12/2004 | Lin | A44B 19/301 70/68 |
| 2006/0185999 | A1 | 8/2006 | Keays | |
| 2006/0225981 | A1 * | 10/2006 | Lin | A45C 13/262 16/113.1 |

FOREIGN PATENT DOCUMENTS

| | | | | | |
|---|---|---|---|---|---|
| CN | 205162201 | U | | 4/2016 | |
| CN | 205267269 | U | | 6/2016 | |
| CN | 106510145 | A | | 3/2017 | |
| CN | 106690721 | A | | 5/2017 | |
| CN | 109662417 | A | | 4/2019 | |
| CN | 111184330 | A | * | 5/2020 | A45C 7/0031 |
| CN | 111990745 | A | | 11/2020 | |
| CN | 113508978 | A | | 10/2021 | |
| CN | 113520002 | A | | 10/2021 | |
| CN | 215014196 | U | | 12/2021 | |
| WO | 9812943 | A1 | | 4/1998 | |
| WO | 2005124247 | A2 | | 12/2005 | |
| WO | 2005124247 | A3 | | 3/2007 | |
| WO | 2011106943 | A1 | | 9/2011 | |

* cited by examiner

TELESCOPIC SUITCASE, AND NOVEL PULL ROD AND SUITCASE BODY THEREOF

CROSS REFERENCE TO THE RELATED APPLICATIONS

This application is the national phase entry of International Application No. PCT/CN2022/103929, filed on Jul. 5, 2022, which is based upon and claims priority to Chinese Patent Applications No. 202110866363.3, filed on Jul. 29, 2021, No. 202110864535.3, filed on Jul. 29, 2021, and No. 202121746957.2, filed on Jul. 29, 2021, the entire contents of which are incorporated herein by reference.

TECHNICAL FIELD

The present disclosure relates to the technical field of suitcases, and in particular to a telescopic suitcase, and a novel pull rod and a suitcase body thereof.

BACKGROUND

A suitcase, also known as a luggage case or trolley case, is a type of luggage used to carry belongings for trips. Usually, a suitcase is configured to contain clothes, personal-care supplies, and souvenirs. The size of suitcases on the market is generally determined based on the requirements of carriers on the sizes of carry-on luggage and checked luggage. The storage space inside the suitcase is fixed and cannot be changed according to actual needs, resulting in poor flexibility and inconvenience in use.

SUMMARY

An objective of the present disclosure is to provide a telescopic suitcase, and a novel pull rod and a suitcase body thereof. The present disclosure can adjust a capacity of the telescopic suitcase by changing relative positions of an upper suitcase body and a lower suitcase body according to an actual need. An upper lid and a lower lid respectively cover an upper compartment and a lower compartment, allowing for quick retrieval and placement of items. In addition, the telescopic suitcase can be pushed and pulled through telescopic rods, offering high flexibility and convenient use.

To achieve the above objective, the present disclosure adopts following technical solutions. A novel pull rod includes telescopic rods, where a lower end of each of the telescopic rods is provided with a suitcase body fixing tube and a suitcase body moving tube; the suitcase body moving tube and the suitcase body fixing tube are fixedly connected to upper and lower ends of a longitudinally telescopic suitcase body, respectively; a lower end of the suitcase body moving tube is provided with a first locking element, and is sheathed inside the suitcase body fixing tube; the first locking element is configured to lock the suitcase body moving tube to the suitcase body fixing tube; the telescopic rod is provided on an upper end of the suitcase body moving tube; and the suitcase body is pushed and pulled through the telescopic rods.

Preferably, the first locking element includes a first base, multiple first locking pins, a first spring, and a first thrust element; the first base is fixedly provided at the lower end of the suitcase body moving tube; the suitcase body fixing tube is provided with multiple first locking holes spaced from top to bottom; the first locking pins and the first spring are provided inside the first base; the first locking pin includes one end connected to the first spring and the other end embedded in the first locking hole; and the first thrust element is provided on the first base, and is configured to drive the first locking pin to retract into the first base.

Preferably, the telescopic rods each include a push-pull fixing tube and a push-pull moving tube; the push-pull fixing tube is sheathed inside the suitcase body moving tube, and includes a lower end fixed to a side of an upper end of the first base; a lower end of the push-pull moving tube is provided with a second locking element, and is sheathed inside the push-pull fixing tube; and the second locking element is configured to lock the push-pull moving tube to the push-pull fixing tube.

Preferably, the second locking element includes a second base, a second locking pin, a second spring, and a second thrust element; the second base is fixedly provided at the lower end of the suitcase body moving tube; the push-pull fixing tube is provided with multiple second locking holes spaced from top to bottom; the second locking pin and the second spring are provided inside the second base; the second locking pin includes one end connected to the second spring and the other end embedded in the second locking hole; and the second thrust element is provided on the second base, and is configured to drive the second locking pin to retract into the second base.

Preferably, there are two first locking pins; the two first locking pins are provided opposite on two sides of the first base; ends of the first spring are fixedly connected to inner ends of the two first locking pins, respectively; an upper end of each of the first locking pins is provided with a first inclined groove; the first thrust element is slidably provided on the first base, and includes a lower end provided with a first inclined protruding portion and an upper end fixed to a first connecting rod; the first connecting rod is located on an outer side of the push-pull fixing tube, and includes an upper end extending from the suitcase body moving tube; and when the first connecting rod is pressed down, the first inclined protruding portion drives the first inclined groove to move inward, such that the first locking pin is retracted into the first base.

Preferably, the second spring includes one end fixedly connected to an inner end of the second locking pin and the other end fixedly connected to the second base; an upper end of the second locking pin is provided with a second inclined groove; the second thrust element is slidably provided on the second base, and includes a lower end provided with a second inclined protruding portion and an upper end fixed to a second connecting rod; the second connecting rod includes an upper end extending from the push-pull moving tube; and when the second connecting rod is pressed down, the second inclined protruding portion drives the second inclined groove to move inward, such that the second locking pin is retracted into the second base.

Preferably, there are two suitcase body fixing tubes provided opposite in the left and right, two suitcase body moving tubes provided opposite in the left and right, and two telescopic rods provided opposite in the left and right; a mounting base is fixed between the upper ends of the two suitcase body moving tubes; a handle is fixed between upper ends of the two push-pull moving tubes; the mounting base is provided with a first driving element; the first driving element is configured to press down the two opposite first connecting rods; the handle is provided with a second driving element; and the second driving element is configured to press down the two opposite second connecting rods.

Preferably, the first driving element includes a first driving key and two first driving rods respectively provided at two sides of the first driving key; two ends of each of the first driving rods are provided with inclined surfaces, and the first driving rods are slidably provided on the mounting base; when the first driving key is pressed down, the two first driving rods are driven to move outward, such that the two first connecting rods are pressed down; the first driving rods each are provided with a first driving spring; and two ends of the first driving spring are respectively connected to the first driving rod and the mounting base to cause the first driving rod to move inward and reset.

Preferably, the second driving element includes a second driving key and two second driving rods respectively provided at two sides of the second driving key; two ends of each of the second driving rods are provided with inclined surfaces; the second driving rod is slidably provided on the handle; when the second driving key is pressed down, the two second driving rods are driven to move outward, such that the two second connecting rods are pressed down; the second driving rods each are provided with a second driving spring; and two ends of the second driving spring are respectively connected to the second driving rod and the handle to cause the second driving rod to move inward and reset.

A suitcase body includes an upper suitcase body and a lower suitcase body, where a lower end of the upper suitcase body is sleeved outside the lower suitcase body; a capacity of a suitcase is adjusted by changing relative positions of the upper suitcase body and the lower suitcase body; the upper suitcase body includes an upper compartment and an upper lid that are provided opposite to each other; an upper locking element is provided between the upper compartment and the upper lid; the upper locking element is configured to detachably connect the upper compartment and the upper lid together; the lower suitcase body includes a lower compartment and a lower lid that are provided opposite to each other; a lower locking element is provided between the lower compartment and the lower lid; and the lower locking element is configured to detachably connect the lower compartment and the lower lid together.

Preferably, the lower end of the upper suitcase body is fixed to an upper limit strip; the upper limit strip extends towards an upper end of an inner side of the upper suitcase body; an upper end of the lower suitcase body is fixed to a lower limit strip; the lower limit strip extends towards a lower end of an outer side of the lower suitcase body; the upper limit strip is embedded in a gap between the lower limit strip and the lower suitcase body from bottom to top; the lower limit strip is embedded in a gap between the upper limit strip and the upper suitcase body from top to bottom; and the upper limit strip and the lower limit strip limit a maximum extension length of the upper suitcase body and the lower suitcase body.

Preferably, an outer wall of the lower suitcase body is fixed to a guide rail along a telescopic direction of the suitcase; an inner wall of the upper suitcase body is fixed to a slider; and the slider is slidably provided on the guide rail.

Preferably, the upper locking element and the lower locking element are zippers.

Preferably, an outer wall of the lower end of the upper suitcase body is fixed to a locking head; and zipper heads of the upper locking element and the lower locking element are locked to the locking head.

Preferably, a bottom of the lower suitcase body is provided with wheels for moving the suitcase.

A telescopic suitcase includes a novel pull rod and a suitcase body, where the novel pull rod includes suitcase body fixing tubes, suitcase body moving tubes, and telescopic rods; the suitcase body includes an upper suitcase body and a lower suitcase body; a lower end of the upper suitcase body is sleeved outside the lower suitcase body; a capacity of the suitcase is adjusted by changing relative positions of the upper suitcase body and the lower suitcase body; the suitcase body moving tubes each include an upper end fixedly connected to the upper suitcase body and a lower end provided with a first locking element; the suitcase body fixing tubes are fixedly connected to the lower suitcase body; the lower end of the suitcase body moving tube is sheathed inside the suitcase body fixing tube; the first locking element is configured to lock the suitcase body moving tube to the suitcase body fixing tube; a bottom of the lower suitcase body is provided with wheels for moving the suitcase; the telescopic rods are respectively provided on the upper ends of the suitcase body moving tubes; and the suitcase is pushed and pulled through the telescopic rods.

With the above technical solutions, the present disclosure has the following beneficial effects.

1. The present disclosure provides a telescopic suitcase and a novel pull rod and suitcase body thereof. According to an actual telescopic height of the telescopic suitcase, relative lengths of the suitcase body fixing tubes and the suitcase body moving tubes are adjusted through the first locking elements, so as to quickly adjust the capacity of the suitcase. In addition, the suitcase is pushed and pulled through the telescopic rod, which is flexible and convenient to use.
2. The present disclosure provides a telescopic suitcase and a novel pull rod and suitcase body thereof. The upper limit strip is embedded in the gap between the lower limit strip and the lower suitcase body from bottom to top, and the lower limit strip is embedded in the gap between the upper limit strip and the upper suitcase body from top to bottom. The upper limit strip and the lower limit strip limit a maximum extension length of the upper suitcase body and the lower suitcase body, so as to prevent the upper suitcase body and the lower suitcase body from slipping off each other.
3. The present disclosure provides a telescopic suitcase and a novel pull rod and suitcase body thereof. The upper locking element and the lower locking element are zippers, and the zipper heads of the upper locking element and the lower locking element are locked to the locking heads, which is simple to operate and convenient to use.
4. The present disclosure provides a telescopic suitcase and a novel pull rod and suitcase body thereof. The first driving key is pressed down to drive the two first driving rods to move outward, thereby pressing the first connecting rods down. When the first connecting rod is pressed down, it drives the first inclined protruding portion to move the first inclined groove inward, such that the first locking pin is retracted into the first base. The height of the suitcase is adjusted by moving the suitcase body moving tube along the suitcase body fixing tube. After the height adjustment is completed, the first driving key is released, and the first locking pin is inserted into the first locking hole under a restoring force of the first spring to lock the suitcase body fixing tube and the suitcase body moving tube. Meanwhile, the first driving spring causes the first driving rod to move inward and reset.
5. The present disclosure provides a telescopic suitcase and a novel pull rod and suitcase body thereof. The second driving key is pressed down to drive the two second driving rods to move outward, thereby pressing the second connecting rods down. When the second connecting rod is pressed down, it drives the second inclined protruding portion to move the second inclined groove inward, such that the second locking pin is retracted into the second base. The height of the handle is adjusted by moving the push-pull moving tube along the push-pull fixing tube. After the height adjustment is completed, the second driving key is released, and the second locking pin is inserted into the second locking hole under a restoring force of the second spring to lock the push-pull fixing tube and the push-pull moving tube. Meanwhile, the second driving spring causes the second driving rod to move inward and reset.

REFERENCE NUMERALS

001. novel pull rod;

1. suitcase body fixing tube; 10. first locking hole; 2. suitcase body moving tube; 3. telescopic rod; 30. push-pull fixing tube; 300. second locking hole; 31. push-pull moving tube; 32. second locking element; 320. second base; 321. second locking pin; 3210. second inclined groove; 322. second spring; 323. second thrust element; 3230. second inclined protruding portion; 324. second connecting rod; 4. first locking element; 40. first base; 41. first locking pin; 410. first inclined groove; 42. first spring; 43. first thrust element; 430. first inclined protruding portion; 44. first connecting rod; 5. mounting base; 50. first driving element; 500. first driving key; 501. first driving rod; 502. first driving spring; 6. handle; 60. second driving element; 600. second driving key; 601. second driving rod; and 602. second driving spring;

002. suitcase body; and

7. upper suitcase body; 70. upper compartment; 71. upper lid; 72. upper locking element; 73. upper limit strip; 74. slider; 75. locking head; 8. lower suitcase body; 80. lower compartment; 81. lower lid; 82. lower locking element; 83. lower limit strip; 84. wheel; and 85. guide rail.

DETAILED DESCRIPTION OF THE EMBODIMENTS

To make the objectives, technical solutions, and advantages of the present disclosure clearer, the present disclosure is described in further detail below with reference to the drawings and embodiments. Understandably, the specific embodiments described herein are merely intended to explain the present disclosure, rather than to limit the present disclosure.

Embodiment 1

Figure 7:
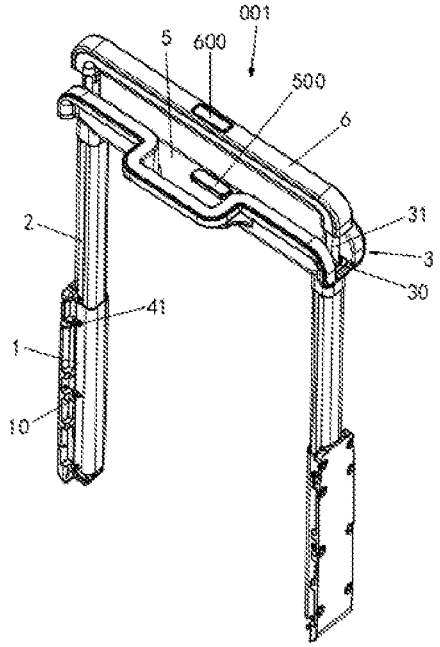
FIG. 7 is a front view of suitcase body fixing tubes, suitcase body moving tubes, and telescopic rods according to the present disclosure.
Figure 8:
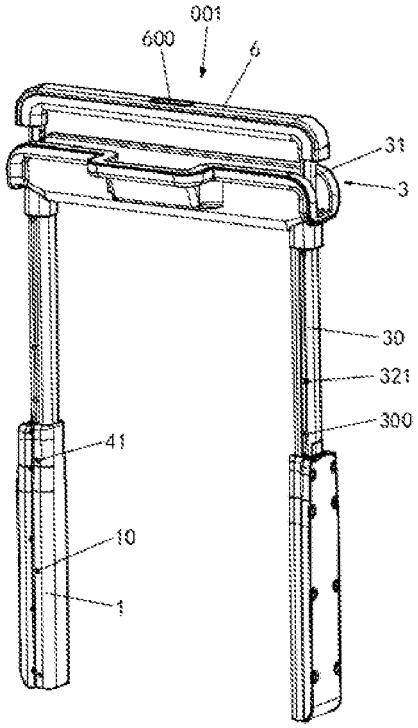
FIG. 8 is a rear view of the suitcase body fixing tubes, the suitcase body moving tubes, and the telescopic rods according to the present disclosure.
Figure 9:
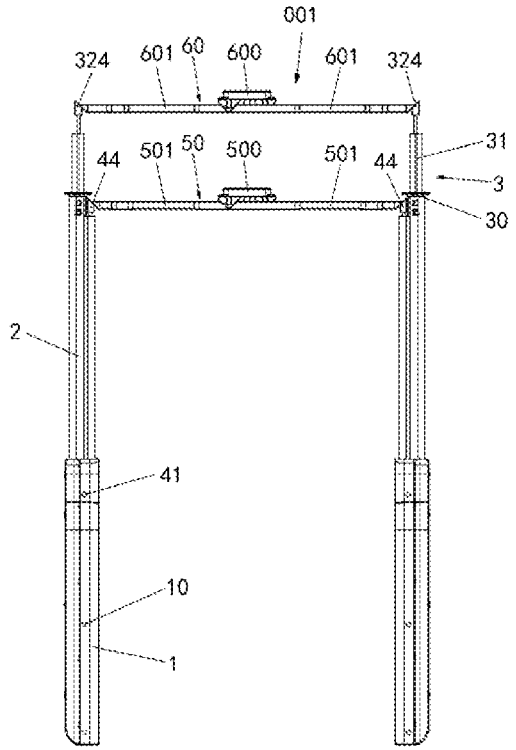
FIG. 9 is a schematic diagram of the suitcase body fixing tubes, the suitcase body moving tubes, and the telescopic rods, with a mounting base and a handle removed, according to the present disclosure.
Figure 10:
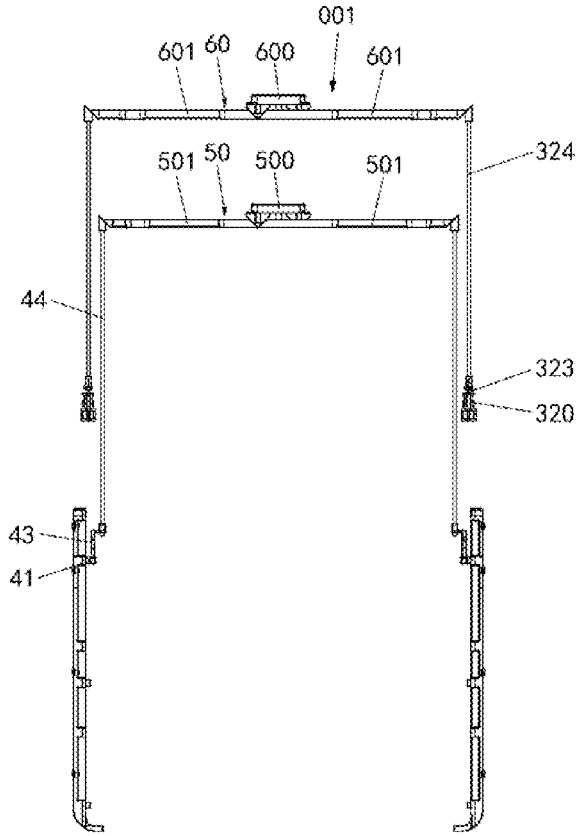
FIG. 10 is a connection diagram of a first driving element and a second driving element according to the present disclosure.
Figure 11:
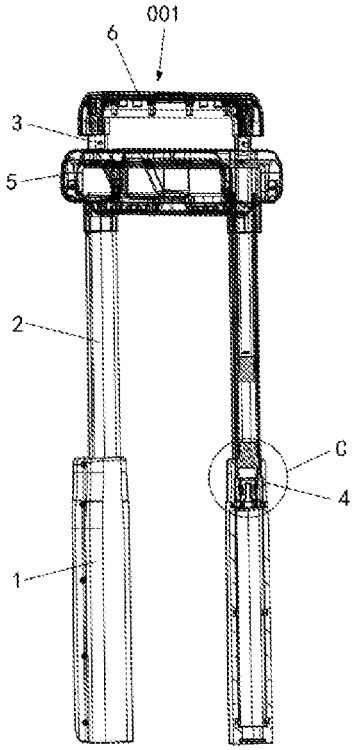
FIG. 11 is a longitudinal view of the suitcase body fixing tubes, the suitcase body moving tubes, and the telescopic rods along a first thrust element according to the present disclosure.
Figure 12:
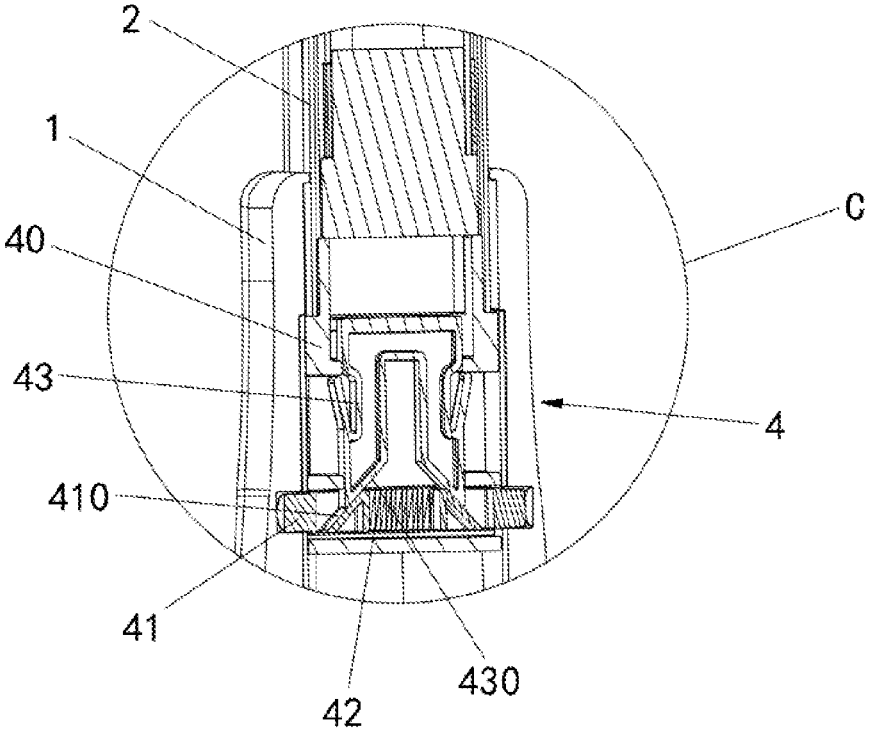
FIG. 12 is an enlarged view of C shown in FIG. 11.
Figure 13:
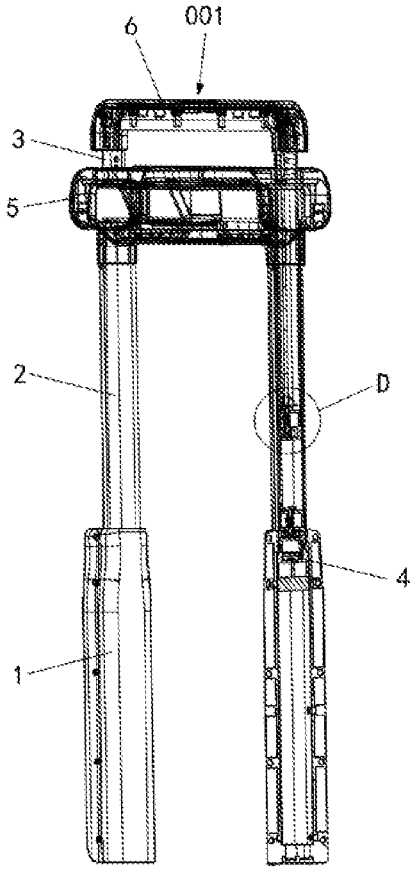
FIG. 13 is a longitudinal view of the suitcase body fixing tubes, the suitcase body moving tubes, and the telescopic rods along a second thrust element according to the present disclosure.
Figure 14:
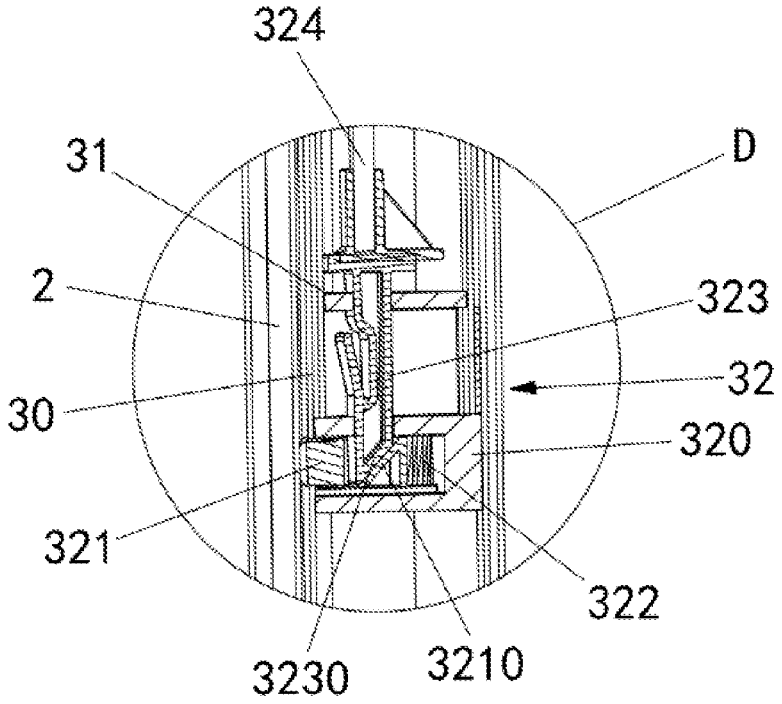
FIG. 14 is an enlarged view of D shown in FIG. 13.
Figure 15:
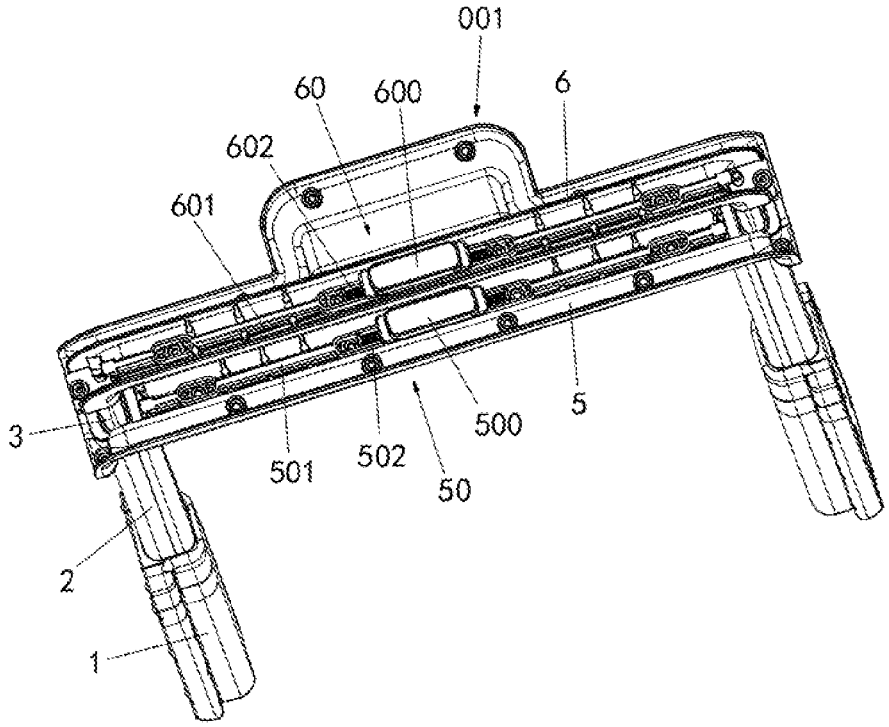
FIG. 15 is a schematic diagram of the first driving element and the second driving element according to the present disclosure.
Figure 16:
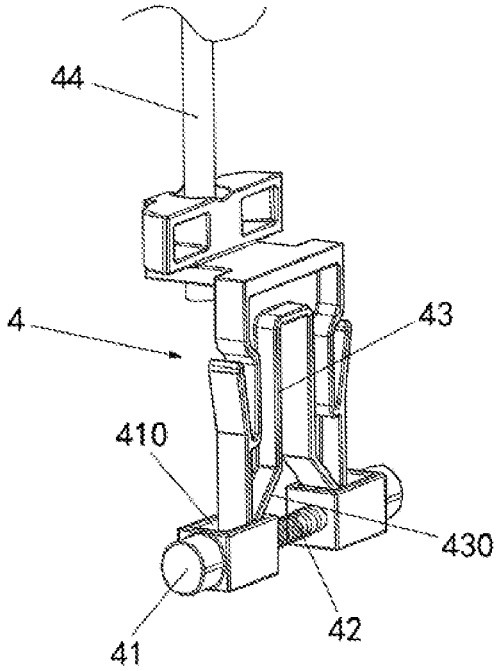
FIG. 16 is a schematic diagram of a first locking element, with a first base removed, according to the present disclosure.
Figure 17:
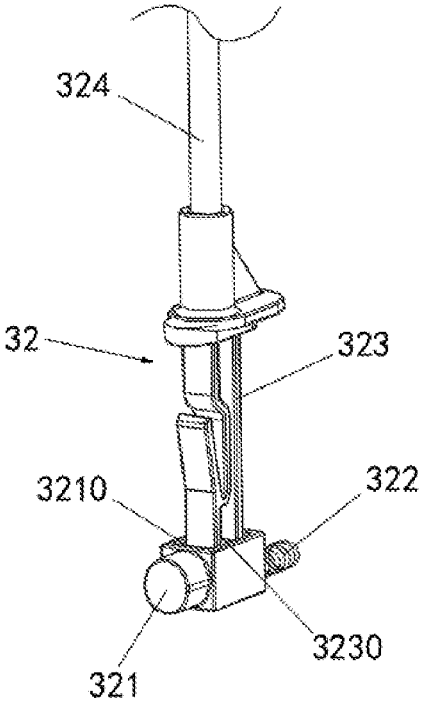
FIG. 17 is a schematic diagram of a second locking element, with a second base removed, according to the present disclosure.

As shown in FIGS. 7 to 17, a novel pull rod includes telescopic rods 3. A lower end of each of the telescopic rods 3 is provided with suitcase body fixing tube 1 and suitcase body moving tube 2. The suitcase body moving tube 2 and the suitcase body fixing tube 1 are fixedly connected to upper and lower ends of a longitudinally telescopic suitcase body, respectively. A lower end of the suitcase body moving tube 2 is provided with first locking element 4, and is sheathed inside the suitcase body fixing tube 1. The first locking element 4 is configured to lock the suitcase body moving tube 2 to the suitcase body fixing tube 1. The telescopic rod 3 is provided on an upper end of the suitcase body moving tube 2. The suitcase body is pushed and pulled through the telescopic rods 3.

The first locking element 4 includes first base 40, multiple first locking pins 41, first spring 42, and first thrust element 43. The first base 40 is fixedly provided at the lower end of the suitcase body moving tube 2. The suitcase body fixing tube 1 is provided with multiple first locking holes 10 spaced from top to bottom. The first locking pins 41 and the first spring 42 are provided inside the first base 40. The first locking pin 41 includes one end connected to the first spring 42 and the other end embedded in the first locking hole 10. The first thrust element 43 is provided on the first base 40, and is configured to drive the first locking pin 41 to retract into the first base 40.

The telescopic rods 3 each include push-pull fixing tube 30 and push-pull moving tube 31. The push-pull fixing tube 30 is sheathed inside the suitcase body moving tube 2, and includes a lower end fixed to a side of an upper end of the first base 40. A lower end of the push-pull moving tube 31 is provided with second locking element 32, and is sheathed inside the push-pull fixing tube 30. The second locking element 32 is configured to lock the push-pull moving tube 31 to the push-pull fixing tube 30.

The second locking element 32 includes second base 320, second locking pin 321, second spring 322, and second thrust element 323. The second base 320 is fixedly provided at the lower end of the suitcase body moving tube 2. The push-pull fixing tube 30 is provided with multiple second locking holes 300 spaced from top to bottom. The second locking pin 321 and the second spring 322 are provided inside the second base 320. The second locking pin 321 includes one end connected to the second spring 322 and the other end embedded in the second locking hole 300. The second thrust element 323 is provided on the second base 320, and is configured to drive the second locking pin 321 to retract into the second base 320.

There are two first locking pins 41. The two first locking pins 41 are provided opposite on two sides of the first base 40. Ends of the first spring 42 are fixedly connected to inner ends of the two first locking pins 41, respectively. An upper end of each of the first locking pins 41 is provided with first inclined groove 410. The first thrust element 43 is slidably provided on the first base 40. The first thrust element 43 includes a lower end provided with first inclined protruding portion 430 and an upper end fixed to first connecting rod 44. The first connecting rod 44 is located on an outer side of the push-pull fixing tube 30, and includes an upper end extending from the suitcase body moving tube 2. When the first connecting rod 44 is pressed down, the first inclined protruding portion 430 drives the first inclined groove 410 to move inward, such that the first locking pin 41 is retracted into the first base 40.

The second spring 322 includes one end fixedly connected to an inner end of the second locking pin 321 and the other end fixedly connected to the second base 320. An upper end of the second locking pin 321 is provided with second inclined groove 3210. The second thrust element 323 is slidably provided on the second base 320. The second thrust element 323 includes a lower end provided with second inclined protruding portion 3230 and an upper end fixed to second connecting rod 324. The second connecting rod 324 includes an upper end extending from the push-pull moving tube 31. When the second connecting rod 324 is pressed down, the second inclined protruding portion 3230 drives the second inclined groove 3210 to move inward, such that the second locking pin 321 is retracted into the second base 320.

There are two suitcase body fixing tubes 1 provided opposite in the left and right, two suitcase body moving tubes 2 provided opposite in the left and right, and two telescopic rods 3 provided opposite in the left and right. Mounting base 5 is fixed between the upper ends of the two suitcase body moving tubes 2. Handle 6 is fixed between upper ends of the two push-pull moving tubes 31. The mounting base 5 is provided with first driving element 50. The first driving element 50 is configured to press down the two opposite first connecting rods 44. The handle 6 is provided with second driving element 60. The second driving element 60 is configured to press down the two opposite second connecting rods 324.

The first driving element 50 includes first driving key 500 and two first driving rods 501 respectively provided at two sides of the first driving key 500. Two ends of each of the first driving rods 501 are provided with inclined surfaces, and the first driving rods 501 are slidably provided on the mounting base 5. When the first driving key 500 is pressed down, the two first driving rods 501 are driven to move outward, such that the two first connecting rods 44 are pressed down. The first driving rods 501 each are provided with first driving spring 502. Two ends of the first driving spring 502 are respectively connected to the first driving rod 501 and the mounting base 5 to cause the first driving rod 501 to move inward and reset.

The second driving element 60 includes second driving key 600 and two second driving rods 601 respectively provided at two sides of the second driving key 600. Two ends of each of the second driving rods 601 are provided with inclined surfaces. The second driving rod 601 is slidably provided on the handle 6. When the second driving key 600 is pressed down, the two second driving rods 601 are driven to move outward, such that the two second connecting rods 324 are pressed down. The second driving rods 601 each are provided with second driving spring 602. Two ends of the second driving spring 602 are respectively connected to the second driving rod 601 and the handle 6 to cause the second driving rod 601 to move inward and reset.

Embodiment 2

Figure 1:
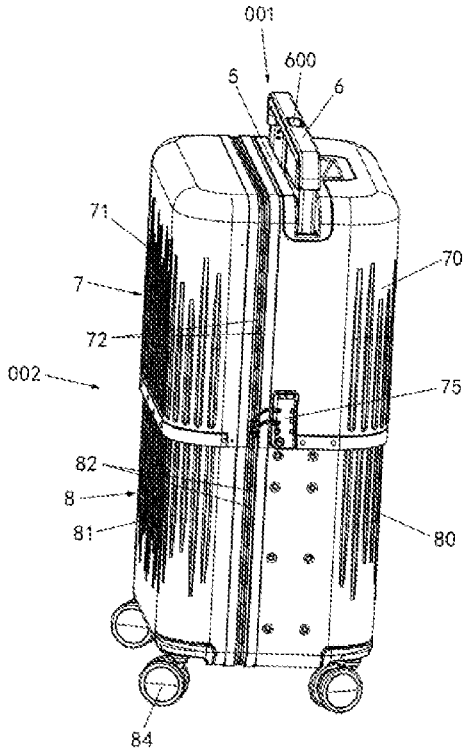
FIG. 1 is a stereoscopic view of a telescopic suitcase according to the present disclosure.
Figure 2:
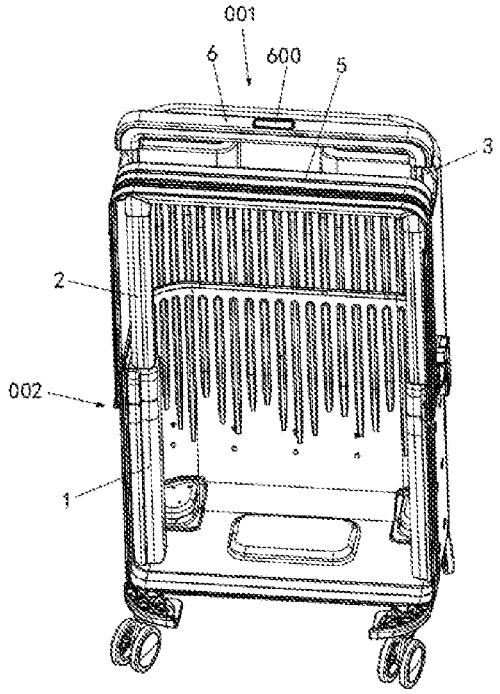
FIG. 2 is an interior view of the telescopic suitcase according to the present disclosure.
Figure 3:
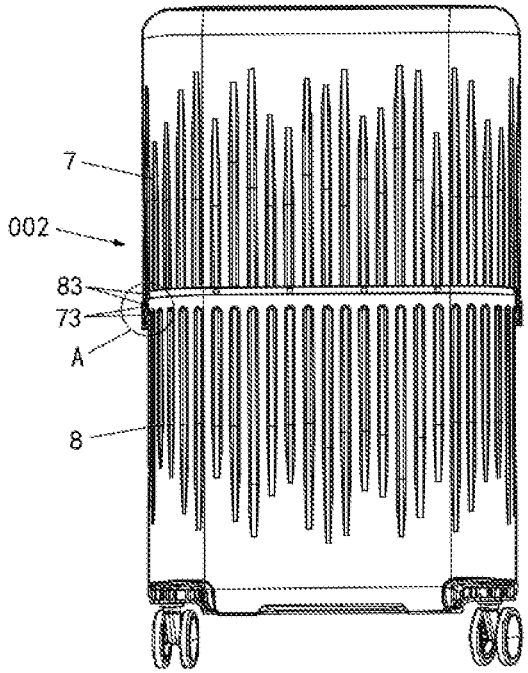
FIG. 3 is a longitudinal view of an upper suitcase body and a lower suitcase body according to the present disclosure.
Figure 4:
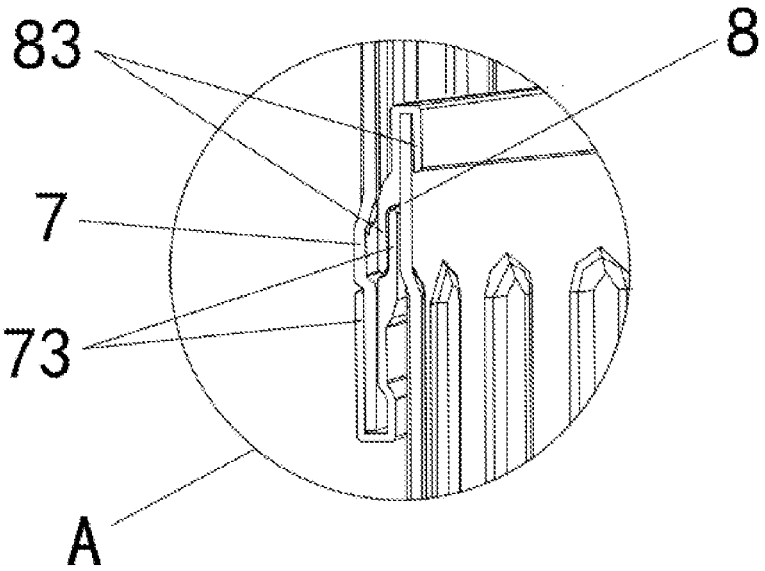
FIG. 4 is an enlarged view of A shown in FIG. 3.
Figure 5:
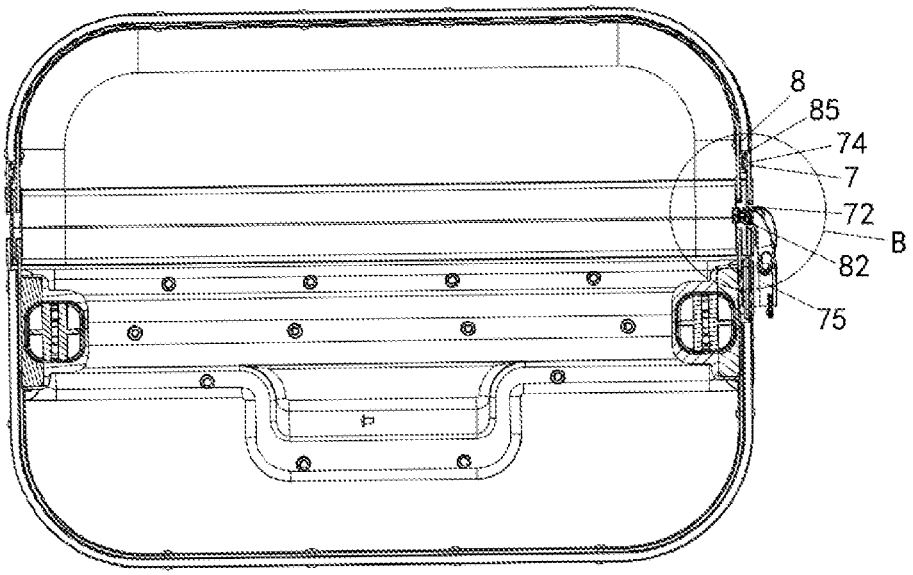
FIG. 5 is a cross sectional view of the telescopic suitcase according to the present disclosure.
Figure 6:
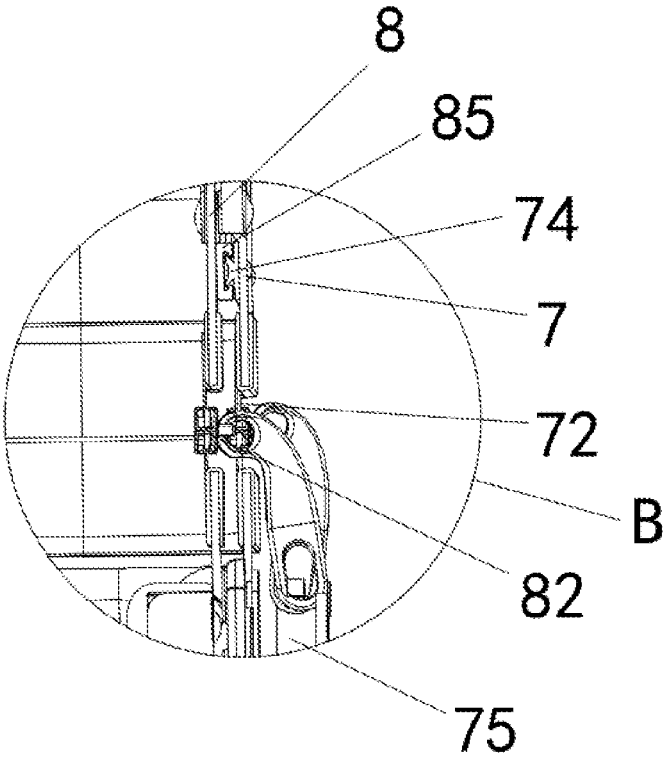
FIG. 6 is an enlarged view of B shown in FIG. 5.

As shown in FIGS. 1 to 6, a suitcase body includes upper suitcase body 7 and lower suitcase body 8. A lower end of the upper suitcase body 7 is sleeved outside the lower suitcase body 8. A capacity of a suitcase is adjusted by changing relative positions of the upper suitcase body 7 and the lower suitcase body 8. The upper suitcase body 7 includes upper compartment 70 and upper lid 71 that are provided opposite to each other. Upper locking element 72 is provided between the upper compartment 70 and the upper lid 71. The upper locking element 72 is configured to detachably connect the upper compartment 70 and the upper lid 71 together. The lower suitcase body 8 includes lower compartment 80 and lower lid 81 that are provided opposite to each other. Lower locking element 82 is provided between the lower compartment 80 and the lower lid 81. The lower locking element 82 is configured to detachably connect the lower compartment 80 and the lower lid 81 together.

The lower end of the upper suitcase body 7 is fixed to upper limit strip 73. The upper limit strip 73 extends towards an upper end of an inner side of the upper suitcase body 7. An upper end of the lower suitcase body 8 is fixed to lower limit strip 83. The lower limit strip 83 extends towards a lower end of an outer side of the lower suitcase body 8. The upper limit strip 73 is embedded in a gap between the lower limit strip 83 and the lower suitcase body 8 from bottom to top. The lower limit strip 83 is embedded in a gap between the upper limit strip 73 and the upper suitcase body 7 from top to bottom. The upper limit strip 73 and the lower limit strip 83 limit a maximum extension length of the upper suitcase body 7 and the lower suitcase body 8.

An outer wall of the lower suitcase body 8 is fixed to guide rail 85 along a telescopic direction of the suitcase. An inner wall of the upper suitcase body 7 is fixed to slider 74. The slider 74 is slidably provided on the guide rail 85.

The upper locking element 72 and the lower locking element 82 are zippers.

An outer wall of the lower end of the upper suitcase body 7 is fixed to locking head 75. Zipper heads of the upper locking element 72 and the lower locking element 82 are locked to the locking head 75.

A bottom of the lower suitcase body 8 is provided with wheels 84 for moving the suitcase.

Embodiment 3

As shown in FIGS. 1 to 17, a telescopic suitcase includes novel pull rod 001 and suitcase body 002. The novel pull rod 001 includes suitcase body fixing tubes 1, suitcase body moving tubes 2, and telescopic rods 3. The suitcase body 002 includes upper suitcase body 7 and lower suitcase body 8. A lower end of the upper suitcase body 7 is sleeved outside the lower suitcase body 8. A capacity of a suitcase is adjusted by changing relative positions of the upper suitcase body 7 and the lower suitcase body 8. The suitcase body moving tubes 2 each include an upper end fixedly connected to the upper suitcase body 7 and a lower end provided with first locking element 4. The suitcase body fixing tubes 1 are fixedly connected to the lower suitcase body 8. The lower end of the suitcase body moving tube 2 is sheathed inside the suitcase body fixing tube 1. The first locking element 4 is configured to lock the suitcase body moving tube 2 to the suitcase body fixing tube 1. A bottom of the lower suitcase body 8 is provided with wheels 84 for moving the suitcase. The telescopic rods 3 are respectively provided on the upper ends of the suitcase body moving tubes 2. The suitcase is pushed and pulled through the telescopic rods 3.

The above are merely preferred specific implementations of the present disclosure, but the protection scope of the present disclosure is not limited thereto. Any modification or replacement easily conceived by those skilled in the art within the technical scope of the present disclosure should fall within the protection scope of the present disclosure. Therefore, the protection scope of the present disclosure should be subject to the protection scope of the claims.

What is claimed is:

1. A pull rod, comprising telescopic rods, wherein a lower end of each of the telescopic rods is provided with a suitcase body fixing tube and a suitcase body moving tube; the suitcase body moving tube and the suitcase body fixing tube are fixedly connected to upper and lower ends of a longitudinally telescopic suitcase body, respectively; a lower end of the suitcase body moving tube is provided with a first locking element and is sheathed inside the suitcase body fixing tube; the first locking element is configured to lock the suitcase body moving tube to the suitcase body fixing tube; each of the telescopic rods is provided on an upper end of the suitcase body moving tube; and the longitudinally telescopic suitcase body is pushed and pulled through the telescopic rods, wherein the first locking element comprises a first base, multiple first locking pins, a first spring, and a first thrust element; the first base is fixedly provided at the lower end of the suitcase body moving tube; the suitcase body fixing tube is provided with multiple first locking holes spaced from a top to a bottom; the multiple first locking pins and the first spring are provided inside the first base; each of the multiple first locking pins comprises a first end connected to the first spring and a second end embedded in one of the multiple first locking holes; and the first thrust element is provided on the first base and is configured to drive the multiple first locking pins to retract into the first base, wherein each of the telescopic rods comprises a push-pull fixing tube and a push-pull moving tube; the push-pull fixing tube is sheathed inside the suitcase body moving tube and comprises a lower end fixed to a side of an upper end of the first base; a lower end of the push-pull moving tube is provided with a second locking element and is sheathed inside the push-pull fixing tube; and the second locking element is configured to lock the push-pull moving tube to the push-pull fixing tube, wherein the second locking element comprises a second base, a second locking pin, a second spring, and a second thrust element; the second base is fixedly provided at the lower end of the suitcase body moving tube; the push-pull fixing tube is provided with multiple second locking holes spaced from the top to the bottom; the second locking pin and the second spring are provided inside the second base; the second locking pin comprises a first end connected to the second spring and a second end embedded in one of the multiple second locking holes; and the second thrust element is provided on the second base and is configured to drive the second locking pin to retract into the second base, wherein there are two first locking pins; the two first locking pins are provided opposite on two sides of the first base; ends of the first spring are fixedly connected to inner ends of the two first locking pins, respectively; an upper end of each of the two first locking pins is provided with a first inclined groove; the first thrust element is slidably provided on the first base and comprises a lower end provided with a first inclined protruding portion and an upper end fixed to a first connecting rod; the first connecting rod is located on an outer side of the push-pull fixing tube and comprises an upper end extending from the suitcase body moving tube and when the first connecting rod is pressed down, the first inclined protruding portion drives the first inclined groove to move inward, such that the two first locking pins are retracted into the first base, wherein the second spring comprises a first end fixedly connected to an inner end of the second locking pin and a second end fixedly connected to the second base; an upper end of the second locking pin is provided with a second inclined groove; the second thrust element is slidably provided on the second base and comprises a lower end provided with a second inclined protruding portion and an upper end fixed to a second connecting rod; the second connecting rod comprises an upper end extending from the push-pull moving tube; and when the second connecting rod is pressed down, the second inclined protruding portion drives the second inclined groove to move inward, such that the second locking pin is retracted into the second base, wherein there are two suitcase body fixing tubes provided opposite in a left and a right, two suitcase body moving tubes provided opposite in the left and the right, and two telescopic rods provided opposite in the left and the right; a mounting base is fixed between upper ends of the two suitcase body moving tubes; a handle is fixed between upper ends of two push-pull moving tubes; the mounting base is provided with a first driving element; the first driving element is configured to press down two opposite first connecting rods; the handle is provided with a second driving element; and the second driving element is configured to press down two opposite second connecting rods.

2. The pull rod according to claim 1, wherein the first driving element comprises a first driving key and two first driving rods respectively provided at two sides of the first driving key; two ends of each of the first driving rods are provided with inclined surfaces, and the two first driving rods are slidably provided on the mounting base; when the first driving key is pressed down, the two first driving rods are driven to move outward, such that the two opposite first connecting rods are pressed down; each of the two first driving rods is provided with a first driving spring; and two ends of the first driving spring are respectively connected to the two first driving rods and the mounting base to cause the two first driving rods to move inward and reset.

3. The pull rod according to claim 1, wherein the second driving element comprises a second driving key and two second driving rods respectively provided at two sides of the second driving key; two ends of each of the two second driving rods are provided with inclined surfaces; the two second driving rods are slidably provided on the handle; when the second driving key is pressed down, the two second driving rods are driven to move outward, such that the two opposite second connecting rods are pressed down; each of the two second driving rods is provided with a second driving spring; and two ends of the second driving spring are respectively connected to the two second driving rods and the handle to cause the two second driving rods to move inward and reset.

* * * * *